United States Patent [19]

Tanabe et al.

[11] Patent Number: 5,044,938

[45] Date of Patent: Sep. 3, 1991

[54] METHOD OF CONTROLLING TEMPERATURE OF A JOINING AREA BETWEEN TWO DIFFERENT STRIP MATERIALS IN A CONTINUOUS STRIP PROCESSING LINE

[75] Inventors: Masao Tanabe, Osaka; Hiroshi Shirono, Habikino, both of Japan

[73] Assignee: Chugai Ro Co., Ltd., Osaka, Japan

[21] Appl. No.: 592,544

[22] Filed: Oct. 2, 1990

[30] Foreign Application Priority Data

Oct. 3, 1989 [JP] Japan ..... 1-258039

[51] Int. Cl.[5] ..... F26B 13/00

[52] U.S. Cl. ..... 432/8; 432/10; 432/24; 432/18; 432/59

[58] Field of Search ..... 432/8, 59, 10, 24, 18, 432/21, 45, 72

[56] References Cited

U.S. PATENT DOCUMENTS

| | | | |
|---|---|---|---|
| 3,170,681 | 2/1965 | Davies | 432/24 |
| 4,116,620 | 9/1978 | Stibbe | 432/59 |
| 4,243,441 | 1/1981 | Wilson | 432/24 |
| 4,371,332 | 2/1983 | Matsuo et al. | 432/59 |
| 4,577,278 | 3/1986 | Schannon | 432/24 |
| 4,767,320 | 8/1988 | Sasaki et al. | 432/72 |
| 4,789,332 | 12/1988 | Ramsey et al. | 432/72 |

*Primary Examiner*—Henry C. Yuen

*Attorney, Agent, or Firm*—Wenderoth, Lind & Ponack

[57] ABSTRACT

Disclosed is a method of controlling the temperature of a joining area between two different strip materials in a continuous strip processing line. In the case where a strip material after the joining area requires a nozzle pressure greater than that of a preceding strip material, the opening of a damper is initially gradually throttled, at a timing before the joining area passes through a predetermined location in a treating furnace, by an amount required for changing the nozzle pressure so that an optimum pressure of the preceding strip material is changed so that of the following strip material. The rotational speed of a recirculation fan is then raised to keep the nozzle pressure substantially constant, and the damper is rapidly opened to the opening before the throttling at a time the joining area passes through the predetermined location. In the case where a strip material after the joining area requires a nozzle pressure less than that of a preceding strip material, the damper opening is initially rapidly throttled at a timing the joining area passes through the predetermined location so that an optimum pressure of the preceding strip material is changed to that of the following strip material. The damper is then gradually opened to the opening before the throttling, and the rotational speed of the recirculation fan is gradually reduced to keep the nozzle pressure substantially constant.

3 Claims, 3 Drawing Sheets

METHOD OF CONTROLLING TEMPERATURE OF A JOINING AREA BETWEEN TWO DIFFERENT STRIP MATERIALS IN A CONTINUOUS STRIP PROCESSING LINE

BACKGROUND OF THE INVENTION

Field of the Invention

The present invention relates to a method of controlling the temperature of a joining area between two different plate-like materials in a continuous strip processing line for performing the coating, drying, baking, or cooling.

Description of the Prior Art

In a conventional continuous strip processing line of this kind, the nozzle pressure (a function of velocity of hot blast blown to a strip from nozzles) in a certain zone of a treating furnace is controlled by either a recirculation fan or a damper. For example, when a joining area between two plate-like materials (i.e., strips) each having a different thickness passes through such a zone, the temperature of a strip in the vicinity of the joining area inevitably deviates from a predetermined target value. In order to minimize the deviation from the target value, the nozzle pressure must be rapidly changed from an optimum value of the preceding strip to that of the following strip by raising the rate of change of the nozzle pressure. This nozzle pressure is represented as a function of the speed of hot air directed to the strip from nozzles and is generally controlled by regulating the rotational speed of the recirculation fan or the opening of the damper.

When the nozzle pressure is controlled by regulating the rotational speed of the recirculation fan, the motor power required to drive the recirculation fan must be increased under the influence of the inertia ($GD^2$) of the recirculation fan itself, to increase the speed of changes in the nozzle pressure. If the recirculation fan is reinforced so as to endure high acceleration and deceleration, the inertia of the recirculation fan itself is required to be increased, thus causing a vicious circle necessitating the increase of the motor power. Accordingly, the speed of change of the practical nozzle pressure is naturally restricted.

On the other hand, when the nozzle pressure is controlled by adjusting the opening of the damper, the controllability of low nozzle pressure in a low air flow is lost or cannot be expected. In operation under the low nozzle pressure, the efficiency of the recirculation fan is relatively low, thus causing undesirable increase in power consumption per unit weight of a product.

SUMMARY OF THE INVENTION

Accordingly, the present invention has been developed to substantially eliminate the above-enumerated disadvantages, and an object of the present invention is to provide a method of controlling the temperature of a joining area between two different materials, which is capable of achieving both the high speed responsibility as an advantage in the case where the nozzle pressure is controlled by the damper opening and the excellent controllability as an advantage in the case where the nozzle pressure is controlled by the rotational speed of a recirculation fan.

Another important object of the present invention is to provide a method of the above-described type which does not cause the excessive enlargement of the recirculation fan, a motor for driving the fan and a VVVF (Variable Voltage Variable Frequency) controller for the fan.

A further object of the present invention is to provide a method capable of reducing the electric power consumption.

In accomplishing these and other objects, a method according to the present invention comprises, in the case where a strip material after the joining area requires a nozzle pressure greater than that of a preceding strip material, the steps of:

gradually throttling the opening of a damper, at a timing before the joining area passes through a predetermined location in a treating furnace, by an amount required for changing a nozzle pressure so that an optimum pressure of the preceding strip material is changed to that of the following strip material;

raising the rotational speed of a recirculation fan to keep the nozzle pressure substantially constant; and rapidly opening the damper to the opening before the throttling at a timing the joining area passes through the predetermined location.

The method according to the present invention further comprises, in the case where a strip material after the joining area requires a nozzle pressure less than that of a preceding strip material, the steps of:

rapidly throttling the opening of the damper at a timing the joining area passes through the predetermined location so that an optimum pressure of the preceding strip material is changed to that of the following strip material;

gradually opening the damper to the opening before the throttling; and gradually reducing the rotational speed of the recirculation fan to keep the nozzle pressure substantially constant.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENTS

Figure 1:
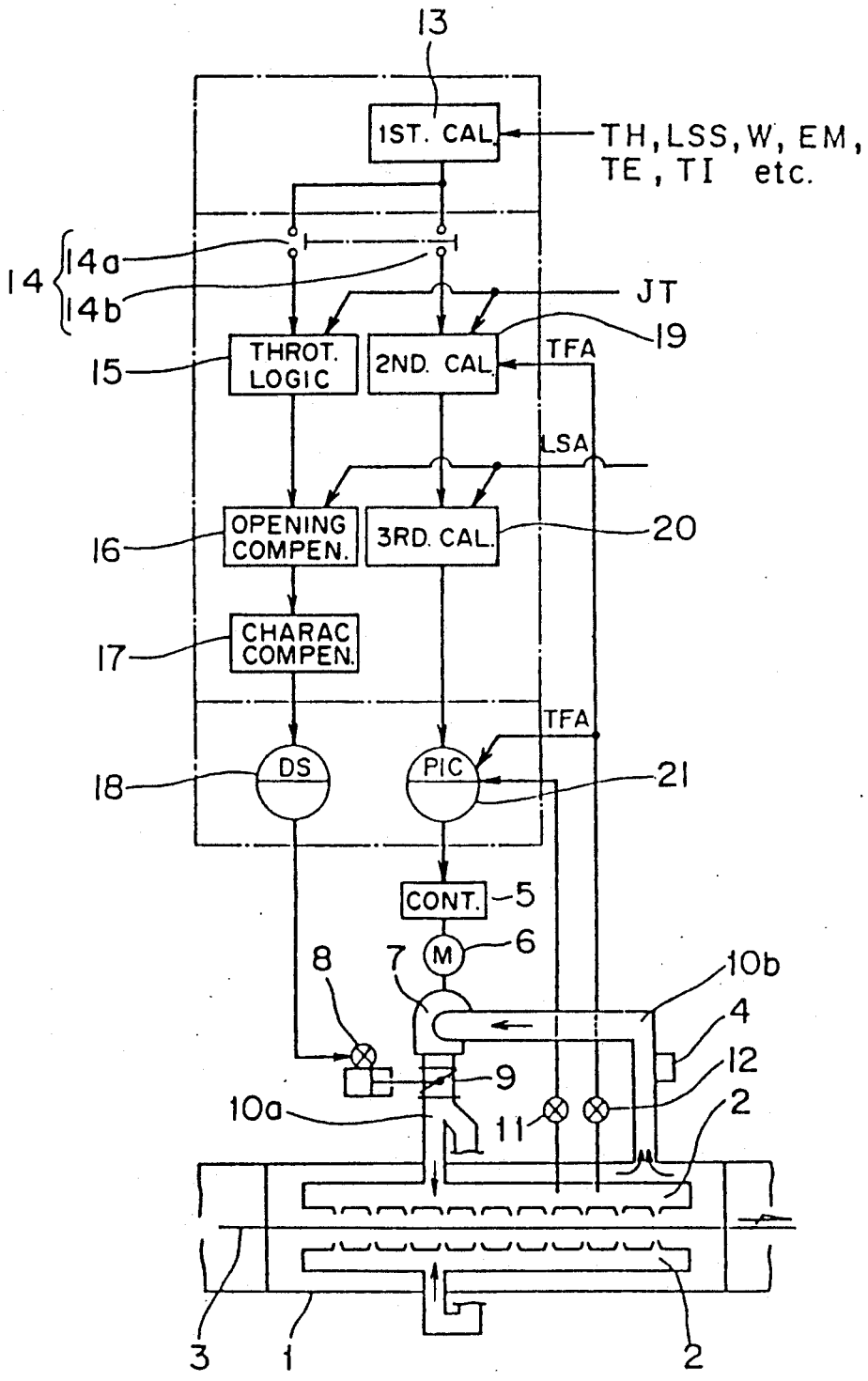
FIG. 1 is a schematic diagram of a system to which a method according to the present invention is applied.

Referring now to the drawings, there is shown in FIG. 1 a control system embodying a method according to the present invention.

A treating furnace to which the present invention is applied has a zone 1 accommodating a series of upper and lower nozzles 2 opposed to each other. In this zone 1, strips 3 to be treated travel between the upper and lower nozzles 2. The nozzles 2 communicate through a supply duct 10*a* and a return duct 10*b* with a recirculation fan 7 driven by a motor 6 having a VVVF (Variable Voltage Variable Frequency) controller 5. The VVVF controller 5 can freely control the frequency and voltage of a power source to be supplied to the motor 6. A burner 4 is securely mounted on the return duct 10*b* to heat air fed from the recirculation fan 7 so that hot air may be blown through the nozzles 2 toward the strips 3. The hot air returns to the recirculation fan 7 through the return duct 10*b*. A damper 9 designed to flap freely is mounted in the supply duct 10*a* to control the amount of hot air supplied from the recirculation fan 7. The opening of the damper 9 is controlled by a damper controller 8 operably connected thereto. The pressure and temperature of the hot air at the location of the nozzles 2 are detected by a pressure detector means 11 and a temperature detector means 12, respectively.

A damper control system for controlling the damper 9 includes a first calculator 13 for calculating a plurality of coefficients required for the calculation of the optimum nozzle pressure, one contact 14*a* of a double-break switch 14, a damper throttling logic 15, a damper opening compensator 16, a damper characteristics compensator 17, a damper opening setting device 18, and the damper controller 8. A fan control system for controlling the recirculation fan 7 includes the first calculator 13, the other contact 14*b* of the double-break switch 14, a second calculator 19 for calculating a plurality of coefficients required for the calculation of the optimum nozzle pressure, a third calculator 20 for calculating the optimum nozzle pressure, a nozzle pressure regulator 21, and the VVVF controller 5.

In the diagram of FIG. 1, an upper frame, a middle frame and a lower frame encompassed by single dotted chain lines represent an off-line calculating section including the first calculator 13, an on-line calculating section including the damper throttling logic 15 and the like, and a control section including the damper opening setting device 18 and the nozzle pressure regulator 21, respectively.

The thickness (TH) and width (W) of strips to be treated, the line speed (LSS) to be set, a radiation heat transfer coefficient (EM), and the outlet and inlet temperatures (TE, TI) of the strips are inputted from the outside of the control systems into the first calculator 13 using a data table. A joint tracking signal (JT) indicative of the joining area between two different strips is inputted into the damper throttling logic 15, and this joint tracking signal (JT) and the actual temperature (TFA) of hot air sent from the temperature detector means 12 are inputted into the second calculator 19. The actual line speed (LSA) is inputted into the damper opening compensator 16 and the third calculator 20. The actual temperature (TFA) of hot air and a pressure signal sent from the pressure detector means 11 are inputted into the nozzle pressure regulator 21.

On the basis of the inputted data indicative of the operating conditions, the first calculator 13 initially calculates the coefficients required for the calculation of the optimum nozzle pressure and obtains the optimum nozzle pressure for each of strips to be treated through the off-line processing.

The double-break switch 14 are turned on when a schedule indicative of various operating conditions of the following strip has been settled (this schedule is hereinafter referred to as the next schedule). Alternatively, the double-break switch 14 may be turned on at the later proper timing.

The damper throttling logic 15 calculates a ratio between a flow coefficient of the recirculation damper for the present schedule and that for the next schedule whereas the damper opening compensator 16 calculates the amount of correction of the damper opening in the case where the line speed is changed. Then, the damper characteristics compensator 17 calculates the opening of the damper 9 on the basis of output signals from the damper throttling logic 15 and the damper opening compensator 16.

Upon receipt of an order of the damper opening which has been compensated for the damper characteristics, the damper opening setting device 18 outputs the optimum damper opening to the damper controller 8 to regulate the opening of the damper 9.

Upon settlement of the next schedule, the second calculator 19 receives the data of the calculation coefficients and the optimum nozzle pressure from the first calculator 13. In this event, the second calculator 19 renews the data of the present schedule altogether by those of the next schedule at the timing when the joining area between adjoining strips passes through the zone 1 i.e., at a timing (B) or (C) where the opening of the damper 9 begins to be changed. While the actual hot air temperature (TFA) is being observed at all times, part of the calculation coefficients for the optimum nozzle pressure is rectified on the basis of the actual hot air temperature (TFA). Furthermore, while the actual line speed (LSA) is being observed at all times, the third calculator 20 rectifies the optimum nozzle pressure outputted through the second calculator 19 from the first calculator 13 on the basis of the rectified calculation coefficients and the actual line speed (LSA) and outputs the rectified value as a setting value of the nozzle pressure.

The nozzle pressure regulator 21 compares this setting value with an actual value of the nozzle pressure converted at the standard temperature. This value can be obtained from the actual hot air temperature (TFA) and the actual value of the nozzle pressure to be inputted. The nozzle pressure regulator 21 then outputs an operation signal so that the difference between both the values may become zero. Thereafter, the rotational speed of the recirculation fan 7 is controlled via the VVVF controller 5 and the motor 6.

In other words, the optimum nozzle pressure is used as a control variable (a target value or a process variable) in the rotational speed control of the recirculation fan 7.

Figure 2:
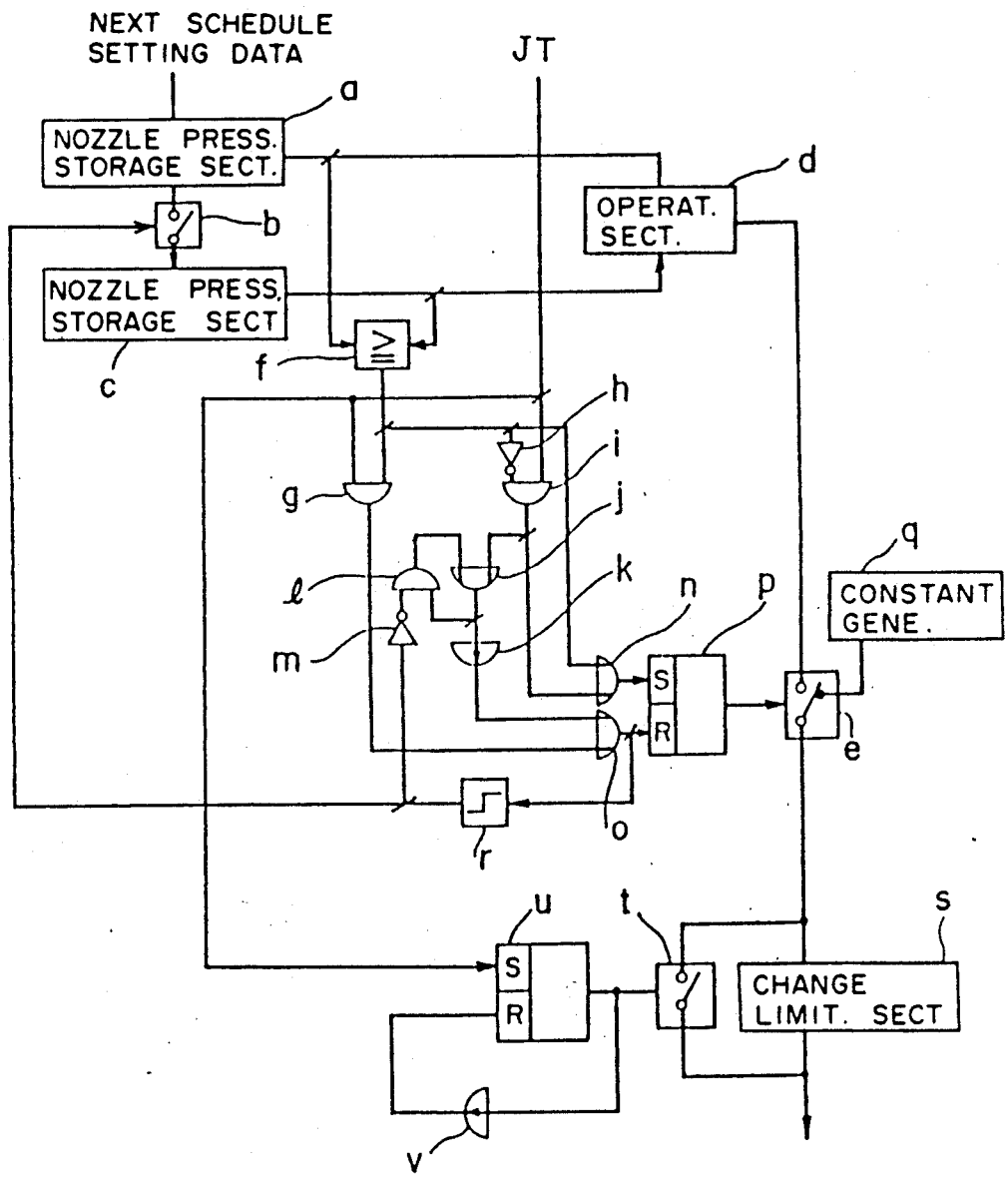
FIG. 2 is a block diagram of one example of a damper throttling logic provided in the system of FIG. 1.

FIG. 2 depicts one example of the damper throttling logic 15.

The setting data for the next schedule are initially inputted into a nozzle pressure storage section (a) for the next schedule, which is connected to a nozzle pressure storage section (c) for the present schedule via an ON-OFF switch (b). The switch (b) is turned on by a signal sent from a leading edge detector (r) formed by, for example, a one shot circuit to enable the data transfer from the nozzle pressure storage section (a) to the nozzle pressure storage section (c). The nozzle pressure storage sections (a) and (c) output respective signals to an operating section (d) and a comparator (f). The operating section (d) calculates the ratio between the flow coefficient of the recirculation damper for the present schedule and that for the next schedule. The comparator (f) outputs a signal to an AND operation element (g) and an OR operation element (n) and to an AND operation element (i) via a NOT operation element (h). An output terminal of the operating section (d) is connected to one stationary contact of a change-over switch (e), the other stationary contact of which is connected to an output terminal of a constant generator (q). The AND operation element (g) receives a joint tracking signal (JT) as well as a signal from the comparator (f) and outputs a signal to an OR operation element (o) whereas the AND operation element (i) receives the same joint tracking signal (JT) as well as a signal from the NOT operation element (h) and outputs a signal to OR operation elements (j) and (n). The OR operation element (j) receives a signal from the AND operation element (i) and that from an AND operation element (1) and outputs a signal to the AND operation element (1) and to the OR operation element (o) via a time limiting element (k). The OR operation element (n) outputs a signal to a setting terminal (S) of a flip-flop (p) whereas the OR operation element (o) outputs a signal to a resetting terminal (R) of the flip-flop (p) and the leading edge detector (r). The leading edge detector (r) outputs a signal to the AND operation element (1) via a NOT operation element and to the switch (b), thereby turning the switch (b) on as described previously. An output signal from the flip-flop (p) connects a movable contact to either one of the two stationary contacts of the change-over switch (e). More specifically, when the flip-flop (p) outputs a setting signal at a high level, the switch (e) permits an output signal from the operating section (d) to pass therethrough whereas, when the flip-flop (p) outputs a reset signal at a low level, the switch (e) permits an output signal from the constant generator (q) to pass therethrough.

Furthermore, a signal from the switch (e) is outputted either directly to the outside of the damper throttling logic 15 via an ON-OFF switch (t) or to a limiting section (s) for limiting the rate of change, depending upon the conditions of the ON-OFF switch (t). The signal inputted into the limiting section (s) is subjected to the limitation in the rate of change and outputted from the damper throttling logic 15.

On the other hand, the joint tracking signal (JT) is inputted into a setting terminal (S) of a flip-flop (u), which outputs a signal to a time limiting element (v) and to the switch (t), thereby turning the switch (t) on. An output signal from the time limiting element (v) is inputted into a resetting terminal (R) of the flip-flop (u).

When the joining area passes through the zone 1, a damper throttling coefficient is calculated, the start timing for throttling the damper and that for recovering the normal damper opening are decided, and the rate of change of the damper opening is selected. The reason for this is that strips before and after the joining area require respective different nozzle pressures, as mentioned previously.

A method according to the present invention is discussed hereinafter which is applied to the apparatus having the above-described construction.

Figure 3:
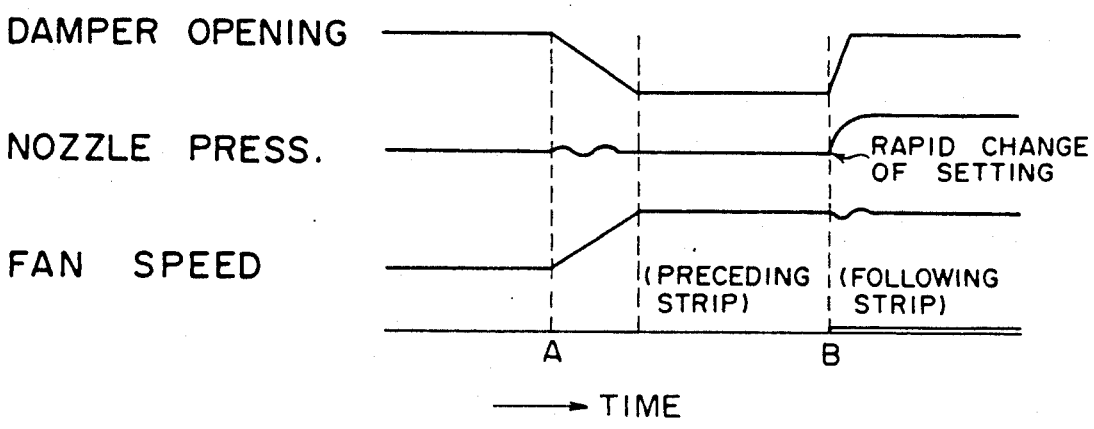
FIGS. 3 and 4 are time charts indicative of the relationship among the damper opening, the nozzle pressure and the speed of a recirculation fan when the nozzle pressure is changed.

As shown in FIG. 3, when the optimum nozzle pressure increases in compliance with a joining area where the preceding thin strip is joined to the following thick strip, the damper opening is set by the damper opening setting device 18 via the damper opening compensator 16 and the damper characteristics compensator 17 on the basis of the value calculated by the damper throttling logic 15. This setting is performed at a timing (A) where the next schedule is properly settled or at a proper timing after the settlement of the next schedule. The damper 9 is then gradually throttled to the opening set by the damper opening setting device 18, and simultaneously, the rotational speed of the recirculation fan 7 gradually increases so as to keep the nozzle pressure substantially constant in the zone Thereafter, the damper 9 is rapidly opened to its normal opening, i.e. substantially the full opening, to make the nozzle pressure become a desired value at a timing (B) where the joining area between the thin strip and the thick strip passes through the zone 1.

It is noted that the aforementioned proper timing after the settlement is a timing capable of ensuring a period of time sufficient for adjusting the damper 9 and the recirculation fan 7 prior to the timing (B) under the conditions in which the nozzle pressure is kept substantially unchanged.

Figure 4:
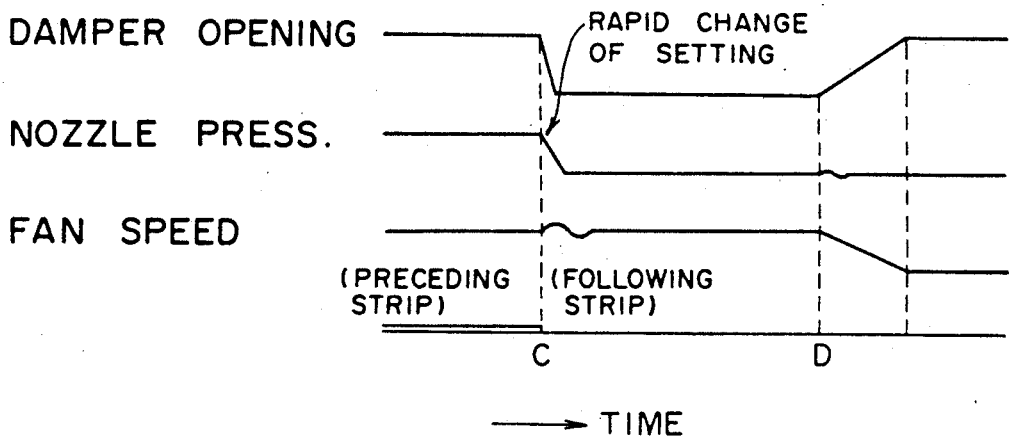

On the other hand, as shown in FIG. 4, when the optimum nozzle pressure reduces in compliance with a joining area where the preceding thick strip is joined to the following thin strip, the damper 9 is rapidly throttled to the opening set by the damper opening setting device 18 on the basis of the value calculated by the damper throttling logic 15. The throttling is performed at a timing (C) where the joining area between the preceding thick strip and the following thin strip passes through the zone 1 so that the nozzle pressure may be reduced to a desired value. Thereafter, the damper 9 is gradually opened to its normal opening at a proper timing (D) after the timing (C). At the timing (D), the control is stabilized. In this event, the rotational speed of the recirculation fan 7 gradually reduces so as to keep the nozzle pressure in the zone 1 substantially constant at the same time the damper 9 is opened.

In this way, when the joining area between adjacent strips, which requires the rapid change of the nozzle pressure, passes through the zone 1, the damper opening is rapidly changed from the value calculated by the damper throttling logic 15 to the normal opening or from the normal opening to the calculated value. Under the normal conditions, the damper opening is kept constant at the normal opening and the nozzle pressure is desirably maintained only by the recirculation fan 7.

In addition to the above, this method is also available in the case where the line speed is changed. Accordingly, the temperature of a strip can be kept substantially constant before and after the change of the line speed, thereby raising the degree of freedom in operation. Furthermore, during the change of the line speed, since the control is performed along with the successive calculation of the optimum nozzle pressure, the fluctuation of the strip temperature can be minimized.

As is clear from the above, according to the present invention, when a joining area between two strip materials each having a different thickness passes through a treating furnace, the region of the strip materials which deviates in temperature from the allowable range can be minimized. Furthermore, since the nozzle pressure is finally controlled by the rotational speed of the recirculation fan, the controllable range thereof can be widened and the excellent controllability can be obtained.

The method according to the present invention also enables the capacity of the VVVF controller for the recirculation fan and that of the drive motor to be less than those in the case where the change of the nozzle pressure depends upon the rotational speed of the recirculation fan. Furthermore, the method according to the present invention can relax the requirements to the strength of the recirculation fan itself. Accordingly, the system, for example, as shown in FIG. 1 can be economically manufactured.

In addition, the method according to the present invention can reduce the power consumption as compared with the case where the nozzle pressure is controlled only by the damper opening.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A method of controlling a temperature of a joining area between two different strip materials in a continuous strip processing line, said method comprising, in the case where a strip material after the joining area requires a nozzle pressure greater than that of a preceding strip material, the steps of:

gradually throttling an opening of a damper, at a timing before the joining area passes through a predetermined location in a treating furnace, by an amount required for changing a nozzle pressure so that an optimum pressure of the preceding strip material is changed to that of the following strip material;

raising a rotational speed of a recirculation fan to keep the nozzle pressure substantially constant; and rapidly opening said damper to the opening before the throttling at a timing the joining area passes through said predetermined location.

2. A method of controlling a temperature of a joining area between two different strip materials in a continuous strip processing line, said method comprising, in the case where a strip material after the joining area requires a nozzle pressure less than that of a preceding strip material, the steps of:

rapidly throttling an opening of a damper at a timing the joining area passes through a predetermined location in a treating furnace so that an optimum pressure of the preceding strip material is changed to that of the following strip material;

gradually opening said damper to the opening before the throttling; and gradually reducing a rotational speed of a recirculation fan to keep the nozzle pressure substantially constant.

3. A method of controlling a temperature of a joining area between two different strip materials in a continuous strip processing line, said method comprising, in the case where a strip material after the joining area requires a nozzle pressure greater than that of a preceding strip material, the steps of:

gradually throttling an opening of a damper, at a timing before the joining area passes through a predetermined location in a treating furnace, by an amount required for changing a nozzle pressure so that an optimum pressure of the preceding strip material is changed to that of the following strip material;

raising a rotational speed of a recirculation fan to keep the nozzle pressure substantially constant; and rapidly opening said damper to the opening before the throttling at a timing the joining area passes through said predetermined location, and said method further comprising, in the case where a strip material after the joining area requires a nozzle pressure less than that of a preceding strip material, the steps of:

rapidly throttling the opening of said damper at a timing the joining area passes through said predetermined location so that an optimum pressure of the preceding strip material is changed to that of the following strip material;

gradually opening said damper to the opening before the throttling; and gradually reducing the rotational speed of said recirculation fan to keep the nozzle pressure substantially constant.

* * * * *